US006461011B1

(12) United States Patent
Harrison

(10) Patent No.: US 6,461,011 B1
(45) Date of Patent: Oct. 8, 2002

(54) SIMULATED FLAME DEVICE

(76) Inventor: Paul Alan Harrison, B8 Marine Gate Marine Drive, Brighton, BN2 5TP (GB)

( * ) Notice: Subject to any disclaimer, the term of this patent is extended or adjusted under 35 U.S.C. 154(b) by 0 days.

(21) Appl. No.: 09/503,759

(22) Filed: Feb. 14, 2000

(30) Foreign Application Priority Data

Feb. 15, 1999 (GB) ..... 9903419

(51) Int. Cl.[7] ..... F21V 33/00
(52) U.S. Cl. ..... 362/96; 362/806; 40/428
(58) Field of Search ..... 362/96, 294, 806, 362/253; 40/428, 436, 439; 392/348; 472/65

(56) References Cited

U.S. PATENT DOCUMENTS 662,708 A * 11/1900 Carter ..... 40/428
1,824,388 A * 9/1931 Birch ..... 40/428

FOREIGN PATENT DOCUMENTS

GB 978364 12/1964
GB 1055577 10/1967
GB 1186655 4/1970
GB 1366791 9/1974
GB 2230335 A 10/1990
GB 2302172 A 1/1997
GB 2323159 9/1998

* cited by examiner

*Primary Examiner*—Y. My Quach-Lee
(74) *Attorney, Agent, or Firm*—Tarolli, Sundheim, Covell, Tummino & Szabo L.L.P.

(57) ABSTRACT

A device for simulating a flame comprises: a housing 12; an elongate flame-shaped piece of collapsible material 14; a lamp 16 for illuminating the piece of material 14; a fan 18 for circulating air in the housing along a predetermined cyclic path in the housing; and an inner housing 20 for mounting a first end portion 22 of the piece of material 14 in said housing such that, in use, the piece of material 14 is supported by said circulating air along the path and a second end portion 24 of the piece of material is free to move in the circulating air.

23 Claims, 5 Drawing Sheets

SIMULATED FLAME DEVICE

BACKGROUND OF THE INVENTION

The invention relates to a device for simulating a flame.

A device for simulating a flame is described in the Applicant's co-pending patent application GB 2323159A. The previous application describes a device in which a flame shaped piece of material is mounted at an opening in a housing and is supported by an air flow emerging from said opening. Such a device creates a realistic flame appearance allowing the flame shaped piece of material to flicker in the air flow like a naked flame.

SUMMARY OF THE INVENTION

An object of the present invention is to provide an improved device for simulating a flame.

The present invention provides a device for simulating a flame, said device comprising: a housing, an elongate flame-shaped piece of collapsible material; means for illuminating said piece of material; circulation means for circulating air in said housing along a predetermined cyclic path in said housing; and means for mounting a first end portion of said piece of material in said housing such that, in use, said piece of material is supported by said circulating air along said path and a second end portion of said piece of material is free to move in said circulating air.

The housing may be substantially air-tight.

Preferably, air circulating along a first portion of said path is for supporting said piece of material and air circulating along a second portion of said path is for circulation back to said first portion of said path. In this case, wall means may separate air along said first portion of said path from air along said second portion of said path.

The circulation means may be disposed in a base which is spaced from a bottom surface of said housing.

The wall means may extend transversely from a surface of said base.

In one embodiment of the invention described hereinafter the wall means is a cylinder.

Preferably, the wall means is at least partially transparent.

The circulation means may comprise a fan.

BRIEF DESCRIPTION OF THE DRAWINGS

In order that the invention may be well understood, two embodiments thereof, which are given by way of example only, will be described with reference to the accompanying drawings, in which.

DESCRIPTION OF PREFERRED EMBODIMENT

Figure 1:
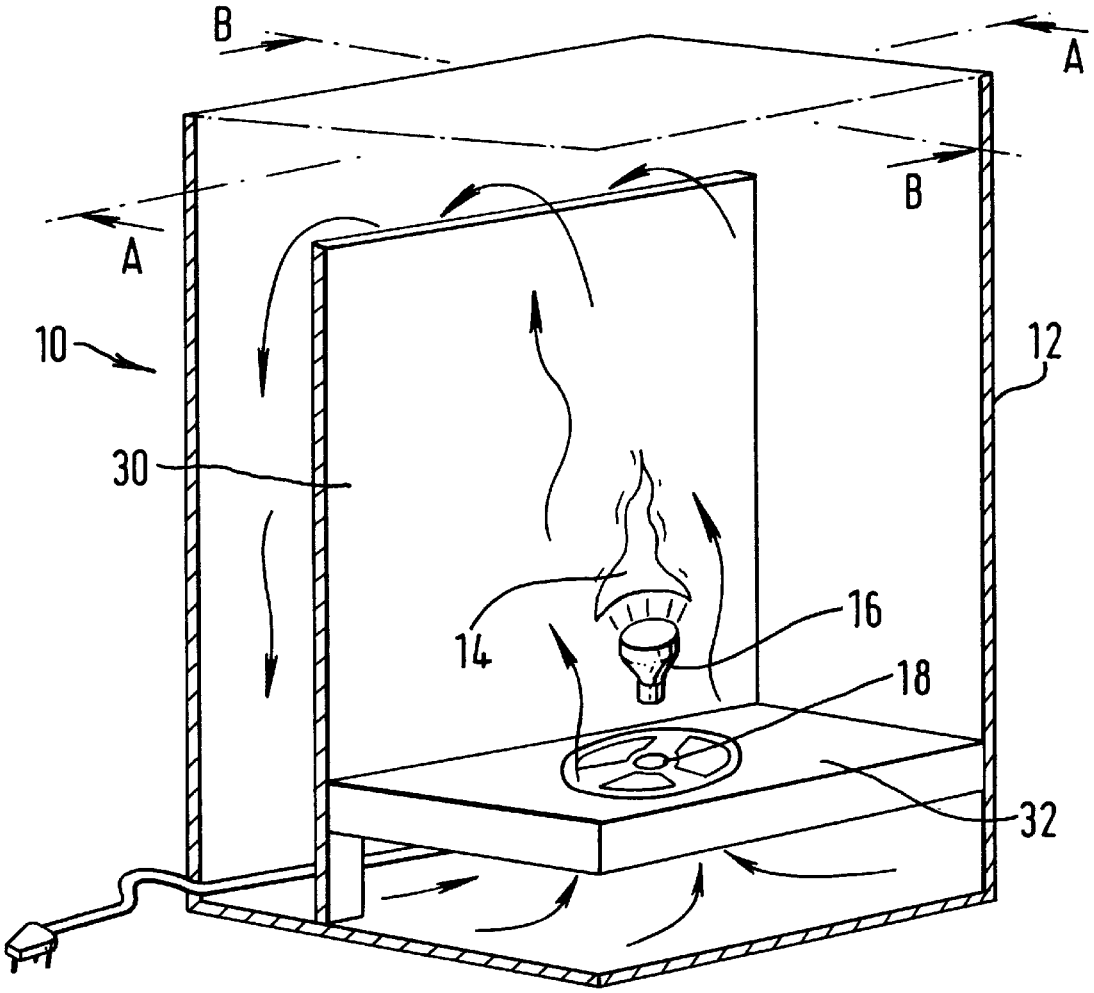
FIG. 1 is a perspective schematic view of a device for simulating a flame.

Referring to the drawings, in which like parts in the embodiments shown in FIGS. 1 to 3 and FIGS. 4 and 5 have been given like references, each embodiment comprises a device 10 for simulating a flame. In each case, the device 10 comprises a housing 12, an elongate flame-shaped piece of collapsible material 14, means 16 for illuminating the piece of material 14, circulation means 18 for circulating air in the housing 12 along a predetermined cyclic path in the housing 12, and means 20 for mounting a first end portion 22 of the piece of material in the housing 12. When the device 10 is in use, the piece of material 14 is supported by the circulating air along the path (shown in the Figures by arrows) and a second end portion 24 of the piece of material 14 is free to move in the circulating air.

The housing 12 is substantially air-tight, in use. However, air will be able to escape from the housing and likewise air outside the housing will be able to enter it because it would not be practical in a device of this type to completely seal the interior of the housing from the exterior thereof. In fact, the housing 12 need only be air-tight to the extent that the device 10 can be, for instance, placed outside without rain, wind etc interfering with the workings of the device 10. The device 10 can also be used inside in which case the substantially air-tight housing inhibits the ingress of dust, smoke and other air-borne pollutants into the housing 12 inhibiting their interference with the workings of the device 10.

Figure 2:
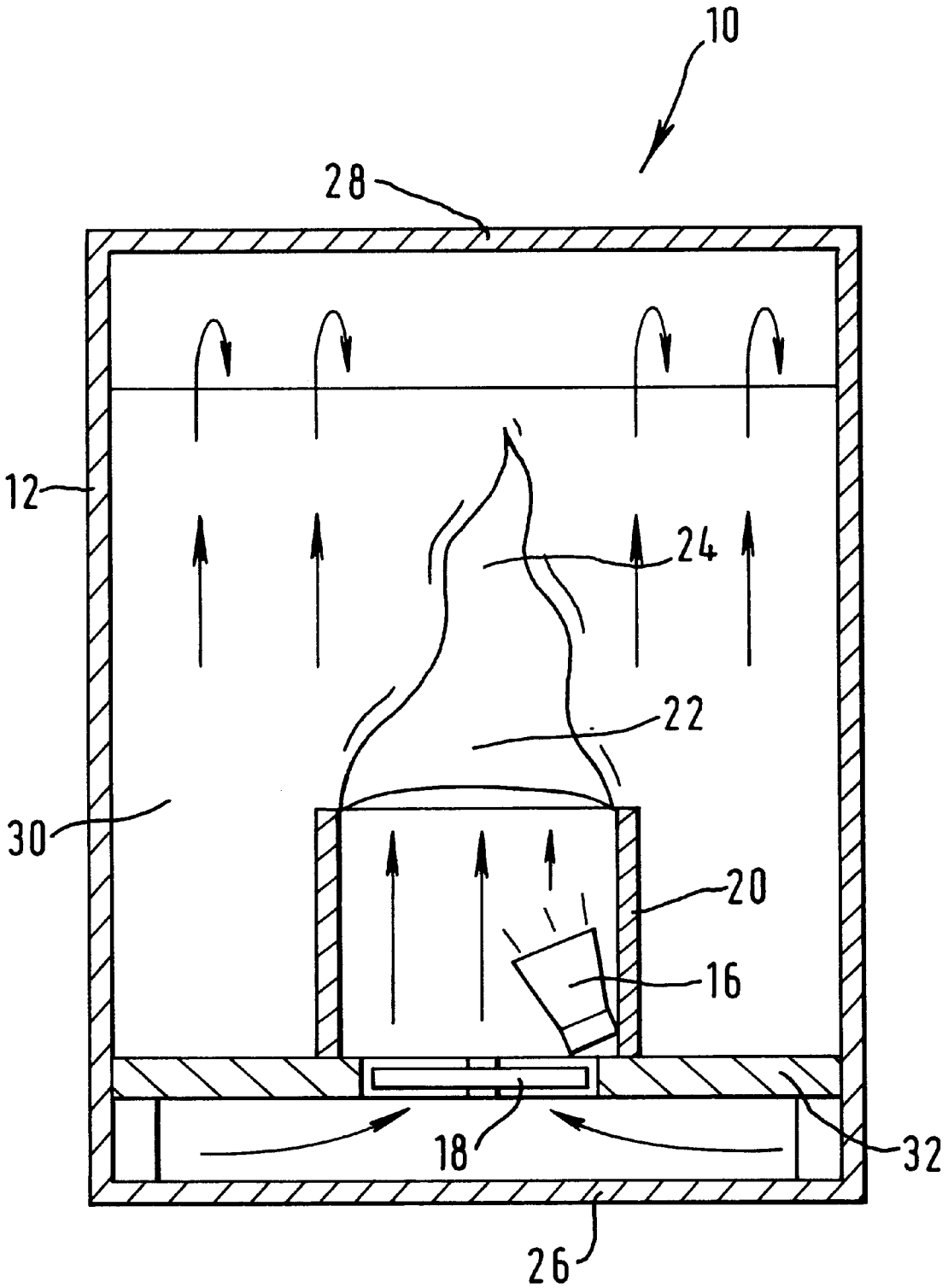
FIG. 2 is a cross-sectional view of the device taken along line A—A shown in FIG. 1.
Figure 3:
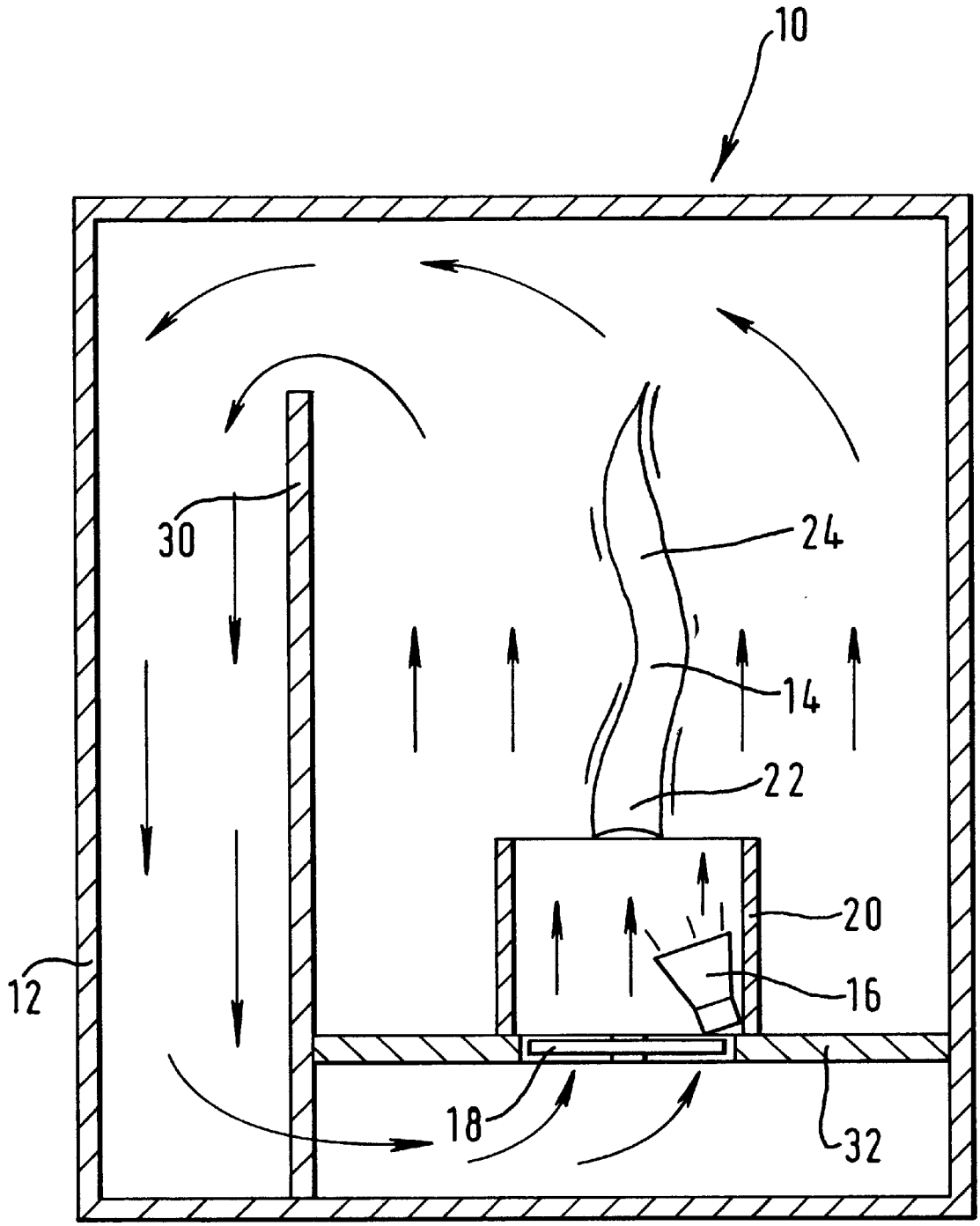
FIG. 3 is a cross-sectional view of the device taken along line B—B shown in FIG. 1.
Figure 4:
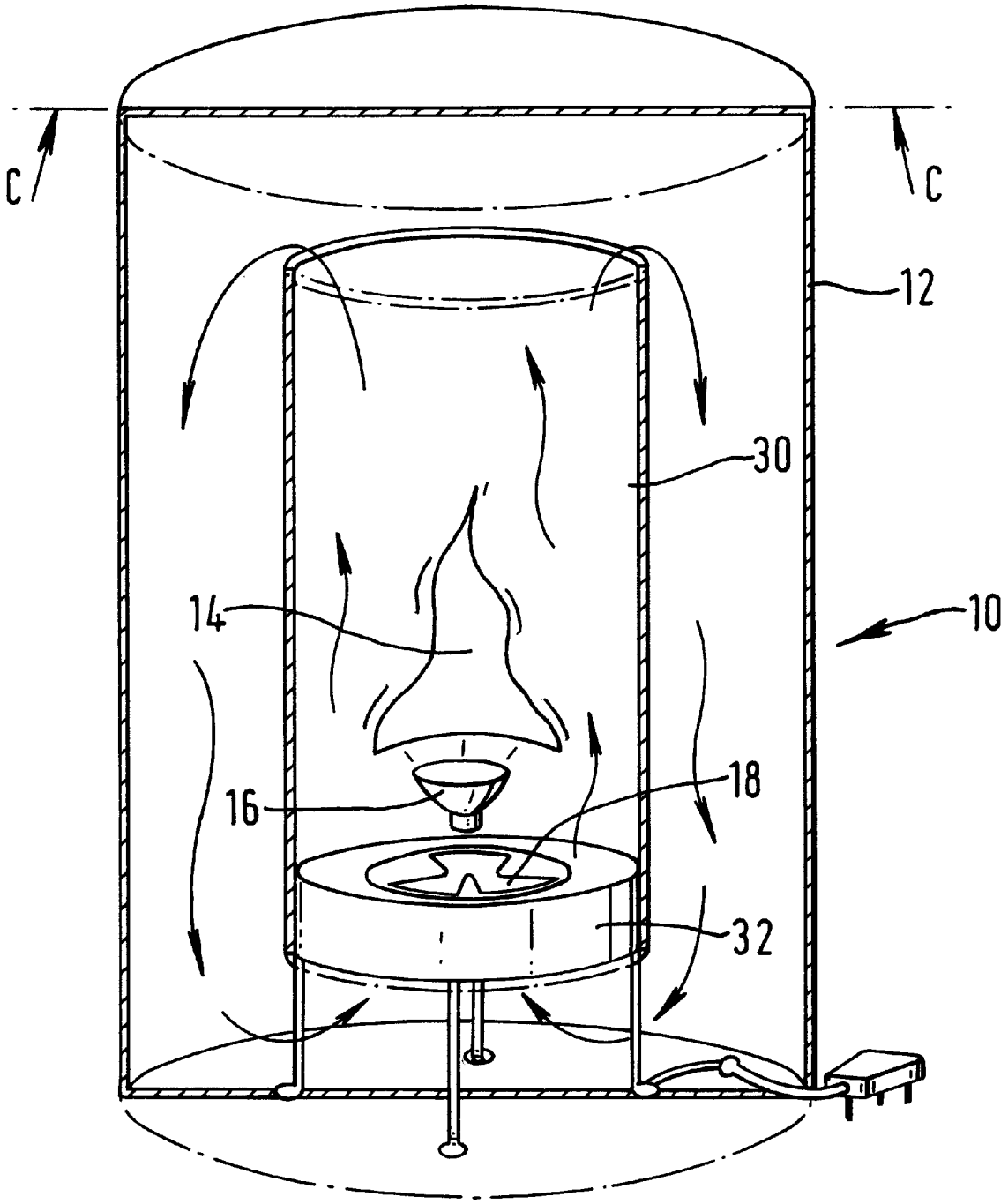
FIG. 4 is a perspective schematic view of another device for simulating a flame.
Figure 5:
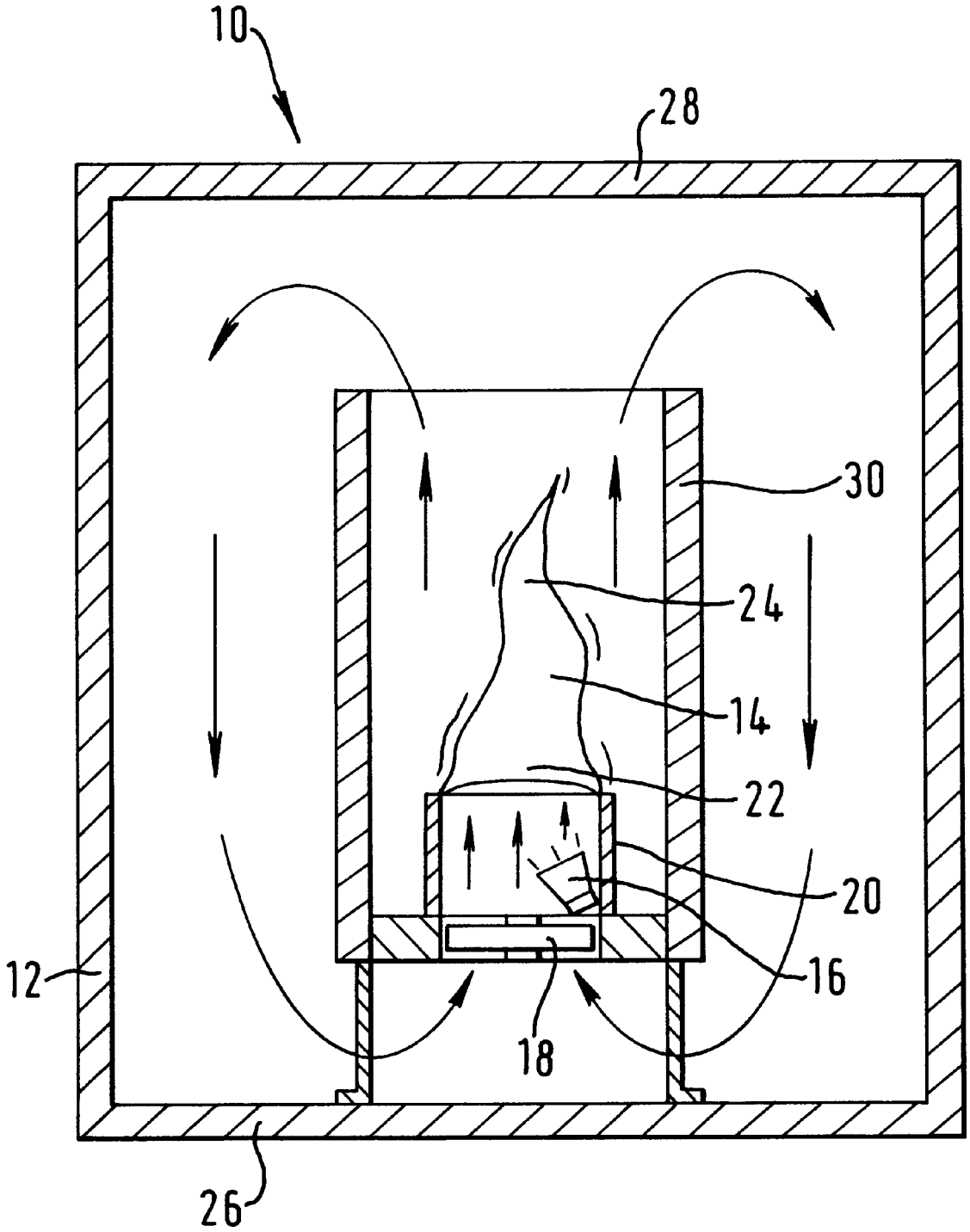
FIG. 5 is a cross-sectional view of a device shown in FIG. 4 taken along line C—C.

The elongate flame-shaped piece of collapsible material 14 is mounted in the housing 12 to an inner housing 20 as shown in FIGS. 2, 3 and 5 (not shown in FIGS. 1 and 4). The inner housing 20 mounts the piece of material 14 in the circulating air along the path. A first end portion 22 of the piece of material 14 is secured to the inner housing 20 by any suitable means such as adhesive. The piece of material 14 may alternatively be secured to a wire which spans across the upper opening of the inner housing 20. The second end portion 24 of the piece of material 14 is not fixed and is therefore, free to move in the circulating air. When the circulating air is controlled correctly, the second end portion 24 wafts, flickers and semi-collapses on itself in the same way as a naked flame of a candle or oil lamp.

The piece of material 14 is preferably made of silk as this is light and reflective, and therefore suitable for the purposes of the device. Other materials may be used instead provided they are sufficiently light and reflective.

As well as simulating the movement of a naked flame, the piece of material 14 must be illuminated to resemble the luminosity of a naked flame. In the illustrated embodiments the piece of material 14 is illuminated by a lamp 16. The lamp 16 should be sufficiently bright to enable light reflected from the piece of material 14 to be of a similar intensity to that of a candle or oil lamp. Preferably, the lamp 16 is positioned to one side in the inner housing as shown in FIGS. 2, 3 and 5 so that the piece of material is illuminated strongest at its lower portion in the same way that the lower portion of a naked flame is the brightest.

For the device 10 to simulate a flame, the flow of air over the elongate flame shaped piece of collapsible material 14 must be sufficient to support the piece of material 14 otherwise it collapses under its own weight. The air flow which supports the piece of material 14 is shown by the arrows in FIGS. 2, 3 and 5 which point vertically up from a bottom surface 26 of the housing 12 towards a top surface 28 of the housing 12 and which circulates along a first portion of the cyclic path. Air flow which does not support the piece of material 14 is shown most clearly in FIGS. 3 and 5 by the arrows which point vertically down from the top surface 28 of the housing 12 towards the bottom surface 26 of the housing 12 and which circulates along a second portion of the cyclic path. Therefore, the air which has passed over and supported the piece of material 14 is circulated to the bottom of the housing 12 without interfering with the air which is supporting the piece of material 14. If the air in the housing was not circulated on a predetermined cyclic path, the flow inside the housing 12 would be randomized and the piece of material 14 would not be adequately supported because air which is not supporting the piece of material would interfere with the air that is. In this case, the supporting air would not be able to provide sufficient supporting force (upward force as shown in the embodiments) and the piece of material would at best not behave like a naked flame or at worst would remain in a collapsed state.

In the embodiments shown in the drawings, the air along the first portion of the predetermined cyclic path is separated from the air along the second portion of the predetermined cyclic path by wall means 30. The wall means 30 in FIGS. 1 to 3 is planar and in FIGS. 4 and 5 is a circular cross-sectional cylinder, however, many other shapes could be adopted whilst still adequately performing the separating function.

The circulation means 18 is disposed in a base 32 in the illustrated embodiments and the base is spaced from the bottom surface 26 of the housing to allow air being circulated to be drawn into the circulation means 18. The circulation means 18 shown is a fan which draws air in from underneath and pushes it upwardly to support the piece of material 14.

The circulation means 18 shown in the embodiments is disposed underneath the piece of material 14. However, the circulation means 18 may be disposed at any part of the predetermined cyclic path provided that adequate circulation in the housing 12 is achieved.

In the illustrated embodiments, the wall means 30 extends upwardly from a surface of the base 32. In this way, the air along the first portion of the predetermined cyclic path is separated from air along the second portion of the predetermined cyclic path by the wall means 30 and from air underneath the fan by the base 32. The base 32 can, however, be omitted without interfering with the supporting action of the air along the first portion of the predetermined cyclic path because air underneath the fan will tend to be drawn into the fan rather than passing to the side of the fan to interfere with the air supporting the piece of material 14.

In the embodiment shown in FIGS. 4 and 5, the wall means 30 is at least partially transparent so that the piece of material 14 can be seen therebehind. The wall means 30 shown in FIGS. 1 to 3 may also be at least partially transparent.

The device may be powered by a battery or from the mains as shown.

The operation of the embodiments will now be described. On rotation of the fan 18 air is drawn into the fan from underneath and expelled upwardly. This air travels over the piece of material 14 exerting an upwards force thereto which serves to support the piece of material 14 and prevent it from completely collapsing. The rate at which the fan is driven is controlled so that the air circulating along the predetermined cyclic path and in particular along the first portion thereof, causes the piece of material 14 to resemble a naked flame (partially collapsing on itself, wafting from side to side, etc). After passing over the piece of material 14, the air is drawn over the top of the wall means 30 and back towards the fan for circulation. In this way the air in the housing can be continuously recycled along the predetermined cyclic path within the housing without the need for air to be drawn into the housing from the exterior thereof. As indicated above, air may be drawn into the housing as it would not be practical to have a completely air-tight housing. When such air is drawn into the housing then a corresponding amount of air is excreted from the housing. Equally though a completely air-tight housing could be used but would obviously be more expensive.

What is claimed is:

1. A device for simulating a flame, said device comprising: a housing; an elongate flame-shaped piece of collapsible material; means for illuminating said piece of material; circulation means for circulating air in said housing along a predetermined cyclic path in said housing; and means for mounting a first end portion of said piece of material in said housing such that, in use, said piece of material is supported by said circulating air along said path and a second end portion of said piece of material is free to move in said circulating air, air circulating along a first portion of said path is for supporting said piece of material and air circulating along a second portion of said path is for circulation back to said first portion of said path, wall means separates air along said first portion of said path from air along said second portion of said path, said circulation means is disposed in a base which is spaced from a bottom surface of said housing, said wall means extends transversely from a surface of said base.

2. A device for simulating a flame, said device comprising a housing, said housing is substantially air tight, an elongate flame-shaped piece of flexible material, said piece of flexible material having a first end portion, a second end portion which is spaced from said first end portion, and major side surfaces extending between said first and second end portions, means for connecting said first end portion of said piece of flexible material with said housing with said second end portion of said piece of flexible material free of connection to a supporting element, means for circulating air in said housing to induce a flow of air which supports said second end portion of said flexible piece of material above said first end portion of said flexible piece of material while said second end portion of said flexible piece of material is free of connection to a supporting element and is free to move in the flow of air, said flow of air induced by said means for circulating air in said housing and being effective to provide the only support for said second end portion of said flexible piece of material to maintain said second end portion of said flexible piece of material above said first end portion of said flexible piece of material, and means for illuminating the second end portion of the flexible piece of material while the second end portion of the flexible piece of material is supported above the first end portion of the flexible piece of material by only the flow of air induced by said means for circulating air in said housing.

3. A device as claimed in claim 2, wherein air moving along a first portion of a cyclic path disposed within said housing is the only support for the second end portion of said flexible piece of material and air moving along a second portion of the cyclic path disposed within said housing is for circulation back to said first portion of the cyclic path.

4. A device as claimed in claim 3, wherein wall means is disposed within said housing and separates air moving along the first portion of the cyclic path from air moving along the second portion of the cyclic path.

5. A device as claimed in claim 4, wherein said wall means is a cylinder.

6. A device as claimed in claim 4, wherein said wall means is at least partially transparent.

7. A device as claimed in claim 2, wherein said circulation means is disposed in a base which is spaced from a bottom surface of said housing.

8. A device as claimed in claim 2, wherein said circulation mean comprises a fan.

9. A device as claimed in claim 2, wherein a wall is disposed in said housing and separates air flowing downward in said housing from said flexible piece of material.

10. A device for simulating a flame, said device comprising a housing, an elongate flame-shaped piece of flexible material, said piece of flexible material having a first end portion, a second end portion which is spaced from said first end portion, and major side surfaces extending between said first and second end portions, means for connecting said first end portion of said piece of flexible material with said housing with said second end portion of said piece of flexible material free of connection to a supporting element, means for circulating air in said housing to induce a flow of air which supports said second end portion of said flexible piece of material above said first end portion of said flexible piece of material while said second end portion of said flexible piece of material is free of connection to a supporting element and is free to move in the flow of air, said flow of air induced by said means for circulating air in said housing and being effective to provide the only support for said second end portion of said flexible piece of material to maintain said second end portion of said flexible piece of material above said first end portion of said flexible piece of material, means for illuminating the second end portion of the flexible piece of material while the second end portion of the flexible piece of material is supported above the first end portion of the flexible piece of material by only the flow of air induced by said means for circulating air in said housing, air circulating along a first portion of a path within said housing is the only support for the second end portion of said flexible piece of material and air circulating along a second portion of said path is for circulation back to said first portion of said path, and wall means disposed within said housing to separate air along said first portion of said path from air along said second portion of said path, said wall means being at least partially transparent.

11. A device for simulating a flame, said device comprising a housing, an elongate flame-shaped piece of flexible material, said piece of flexible material having a first end portion, a second end portion which is spaced from said first end portion, and major side surfaces extending between said first and second end portions, means for connecting said first end portion of said piece of flexible material with said housing with said second end portion of said piece of flexible material free of connection to a supporting element, means for circulating air in said housing to induce a flow of air which supports said second end portion of said flexible piece of material above said first end portion of said flexible piece of material while said second end portion of said flexible piece of material is free of connection to a supporting element and is free to move in the flow of air, said flow of air induced by said means for circulating air in said housing and being effective to provide the only support for said second end portion of said flexible piece of material to maintain said second end portion of said flexible piece of material above said first end portion of said flexible piece of material, said means for circulating air in said housing is disposed in a base which is spaced from a bottom surface of said housing, and means for illuminating the second end portion of the flexible piece of material while the second end portion of the flexible piece of material is supported above the first end portion of the flexible piece of material by only the flow of air induced by said means for circulating air in said housing.

12. A device as claimed in claim 11, wherein air moving along a first portion of a cyclic path disposed within said housing is the only support for the second end portion of said flexible piece of material and air moving along a second portion of the cyclic path disposed within said housing is for circulation back to said first portion of the cyclic path.

13. A device as claimed in claim 12, wherein wall means is disposed within said housing and separates air moving along the first portion of the cyclic path from air moving along the second portion of the cyclic path.

14. A device as claimed in claim 13, wherein said wall means is a cylinder.

15. A device as claimed in claim 13, wherein said wall means is at least partially transparent.

16. A device as claimed in claim 11, wherein said circulation mean comprises a fan.

17. A device for simulating a flame, said device comprising a housing, an elongate flame-shaped piece of flexible material, said piece of flexible material having a first end portion, a second end portion which is spaced from said first end portion, and major side surfaces extending between said first and second end portions, means for connecting said first end portion of said piece of flexible material with said housing with said second end portion of said piece of flexible material free of connection to a supporting element, means for circulating air along a cyclic path disposed within said housing to induce a flow of air which supports said second end portion of said flexible piece of material above said first end portion of said flexible piece of material while said second end portion of said flexible piece of material is free of connection to a supporting element and is free to move in the flow of air, said flow of air induced by said means for circulating air in said housing being effective to provide the only support for said second end portion of said flexible piece of material to maintain said second end portion of said flexible piece of material above said first end portion of said flexible piece of material, and means for illuminating at least the second end portion of the flexible piece of material while the second end portion of the flexible piece of material is supported above the first end portion of the flexible piece of material by only the flow of air induced by said means for circulating air in said housing.

18. A device as claimed in claim 17, wherein said housing is constructed so as to block flow of air from the cyclic path disposed with said housing.

19. A device as claimed in claim 17, wherein air moving along a first portion of the cyclic path within said housing is the only support for the second end portion of said flexible piece of material and air moving along a second portion of the cyclic path within said housing to the first portion of the cyclic path is spaced from said flexible piece of material.

20. A device as claimed in claim 19, wherein a wall disposed within said housing and separates air moving along said first portion of the cyclic path from air moving along said second portion of the cyclic path.

21. A device as claimed in claim 20, wherein said wall is a cylinder.

22. A device as claimed in claim 20, wherein said wall is at least partially transparent.

23. A device as claimed in claim 17, wherein said means for circulating air is disposed in a lower end portion of said housing.

* * * * *